US006467764B1

(12) United States Patent
Stevens

(10) Patent No.: US 6,467,764 B1
(45) Date of Patent: Oct. 22, 2002

(54) HIGH CAPACITY DOCUMENT SHEET PROCESSOR

(75) Inventor: Kenneth A. Stevens, 36W642 Lancaster Rd., St. Charles, IL (US) 60175

(73) Assignee: Kenneth A. Stevens, Betavia, IL (US)

( * ) Notice: Subject to any disclaimer, the term of this patent is extended or adjusted under 35 U.S.C. 154(b) by 38 days.

(21) Appl. No.: 09/666,097

(22) Filed: Sep. 21, 2000

Related U.S. Application Data

(60) Provisional application No. 60/155,948, filed on Sep. 24, 1999, and provisional application No. 60/155,949, filed on Sep. 24, 1999.

(51) Int. Cl.[7] ..... B65H 5/22

(52) U.S. Cl. ..... 271/4.01; 271/38; 271/34; 271/129; 271/130; 271/148; 271/150

(58) Field of Search ..... 271/4.01, 31, 31.1, 271/34, 38, 129, 130, 148, 149, 150

(56) References Cited

U.S. PATENT DOCUMENTS

| | | | |
|---|---|---|---|
| 4,928,944 | A | 5/1990 | Golicz |
| 5,887,864 | A | 3/1999 | Stevens et al. |
| 6,142,462 | A | 11/2000 | Moser et al. |

*Primary Examiner*—Donald P. Walsh
*Assistant Examiner*—Kenneth Bower
(74) *Attorney, Agent, or Firm*—Lee, Mann, Smith, McWilliams, Sweeney & Ohlson

(57) ABSTRACT

A high capacity document sheet processor combines significant speed and efficiency enhancing improvements in existing approaches to stack feeding particularly in the stack loading, feeding and singulating functions with novel operational arrangements adaptable to a universal paper handling and envelope inserting system.

9 Claims, 17 Drawing Sheets

HIGH CAPACITY DOCUMENT SHEET PROCESSOR

RELATED APPLICATIONS

This application claims priority from provisional application No. 60/155,948 filed Sep. 24, 1999 and provisional application No. 60/155,949 filed Sep. 24, 1999.

BACKGROUND OF THE INVENTION

1. Field of the Invention

A need exists to accurately and quickly feed stacks of paper to high speed envelope inserting machinery, particularly the type known generically as the 'Phillipsburg' type, for sheet feeding devices that handle a wide variety of physical forms and can combine different forms for ease of operation, reduced operator intervention and improved reliability. This invention feeds stacked, precut forms, provided in sequential for placing in an inserter stream using a slanted table, a generally vertical wall and optimized feed and singulator mechanisms. This invention is adapted to direct feeding into an envelope inserter, or for inclusion in a continuous feed format handling device such as my coinvented, U.S. Pat. No. 5,887,864 entitled "Method of and apparatus for processing and stacking printed forms" which issued Mar. 30, 1999, which is incorporated by reference as if fully set forth herein. Direct feeding into an envelope inserter is also taught in the Golicz U.S. Pat. No. 4,928,944 entitled "High speed sheet feeder singulator" which issued May 29, 1990 which shares superficial similarities with this invention, but has weaknesses in the speed, accuracy and economy areas. This patent is also incorporated by reference as if fully set forth herein.

2. Description of Related Art

U.S. Pat. No. 5,887,864 entitled "Method of and apparatus for processing and stacking printed forms" which issued Mar. 30, 1999, which is incorporated by reference as if fully set forth herein. Golicz, U.S. Pat. No. 4,928,944 entitled "High speed sheet feeder singulator" which issued May 29, 1990 teaches direct feeding into an envelope inserter or other device from a stack on a tilted table, but does not suggest or teach the directional, dimensional or angular control of this invention and therefore has weaknesses in speed, accuracy and economy.

SUMMARY OF INVENTION

The invention uses paper vertically stacked on a feed table positioned against a top-edge guide assembly spacing the paper stack from a vertical deck and separates the lead documents from the stack. Creeper belts feed the paper to the singulator device. Precise control over the movement of the belts enables a precise feed to the singulator assembly, which combines dimensional and directional control of the paper leading edge to optimize speed and accuracy. Among the unique features of and operations enabled by the invention are the ability to reverse the creeper belts, creeper belt control as to speed and timing, auto advancing of the singulator, enablement of manual document feeding without system reset, a tilt back feature enabling maintenance and jam clearing, the ability to receive auxiliary input and dual input and improved feeding taking advantage of the upper edge paper guides.

BRIEF DESCRIPTION OF DRAWINGS

The following drawings, in which like reference characters indicate like parts, are illustrative of embodiments of the invention and are not intended to limit the scope of the invention in any manner whatsoever, as encompassed by the claims forming a part hereof.

DESCRIPTION OF THE DRAWINGS

Figure 1:
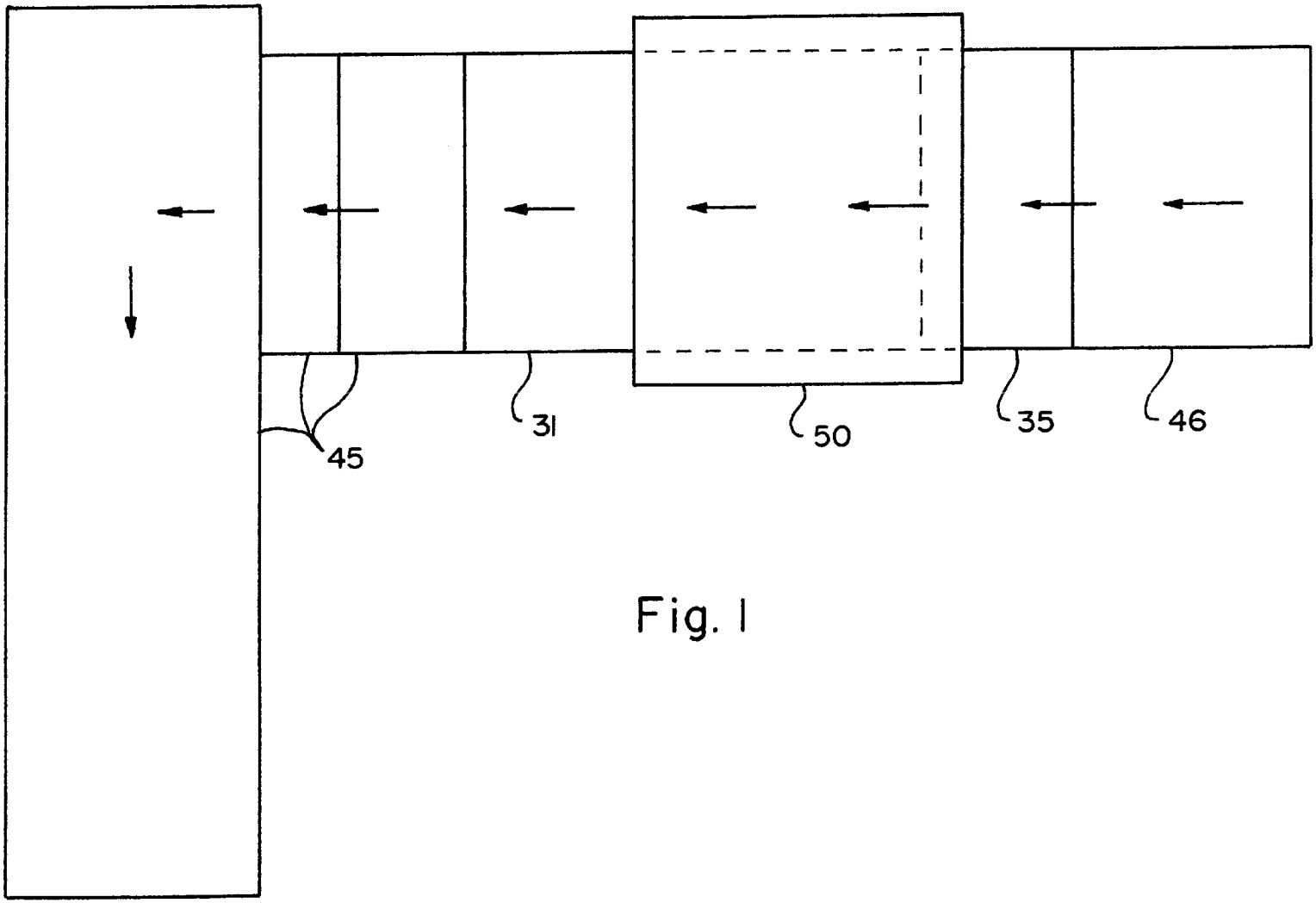

FIG. 1 is a block diagram showing the preferred use of the invention.

Figure 2:
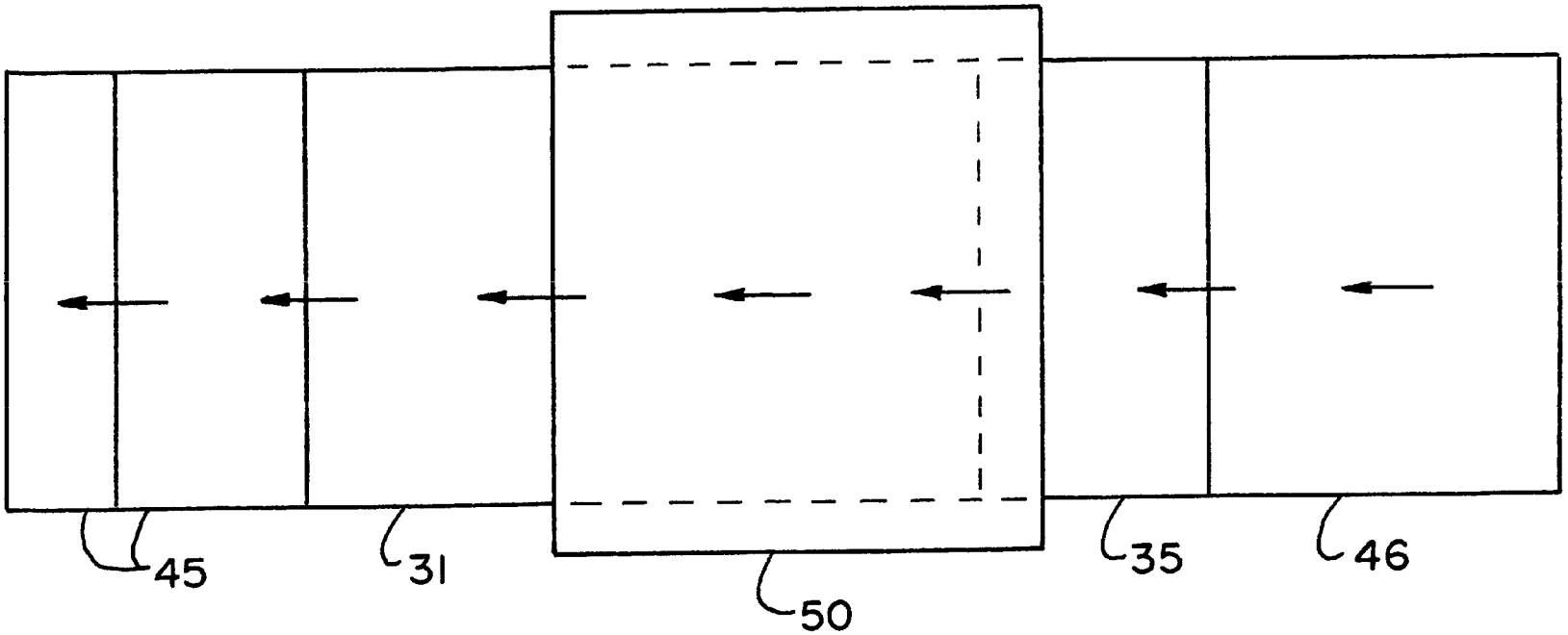

FIG. 2 is a block diagram showing a first alternative embodiment of the invention with alternative downstream devices.

Figure 3:
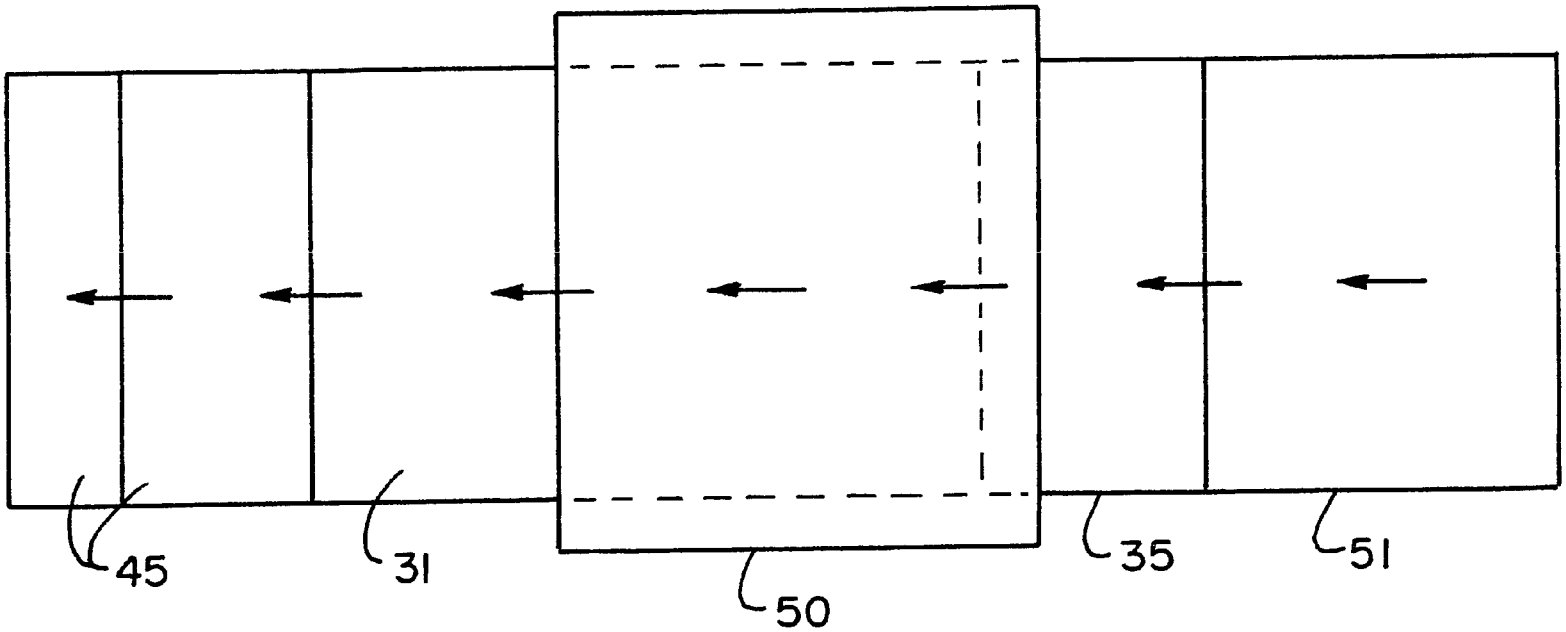

FIG. 3 is a block diagram showing,a,second alternative embodinent of the invention with an auxiliary input and auxiliary downstream device.

Figure 4:
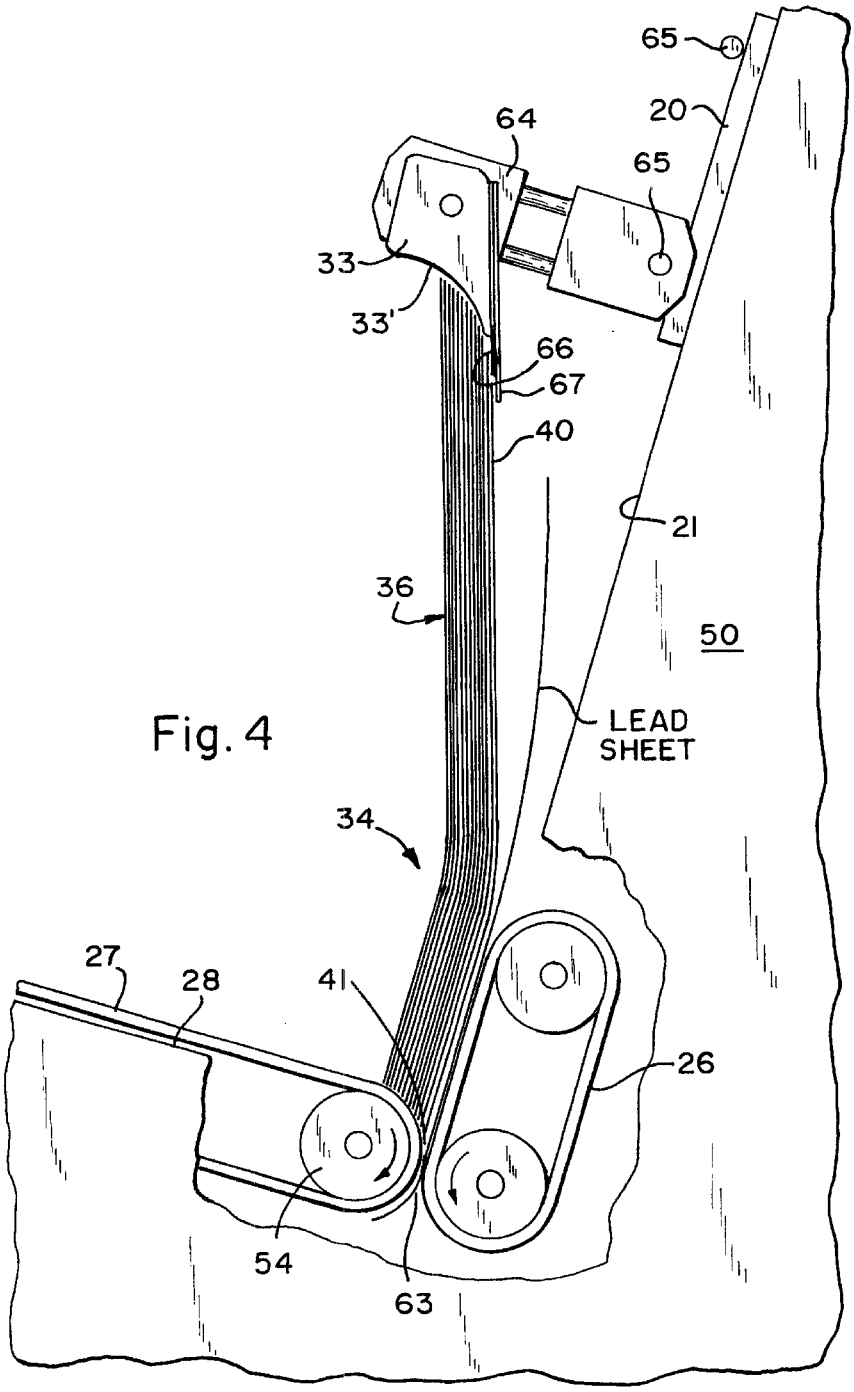

FIG. 4 is an elevational view of the upper edge paper guide and portion of the singulator assembly of the invention.

Figure 5:
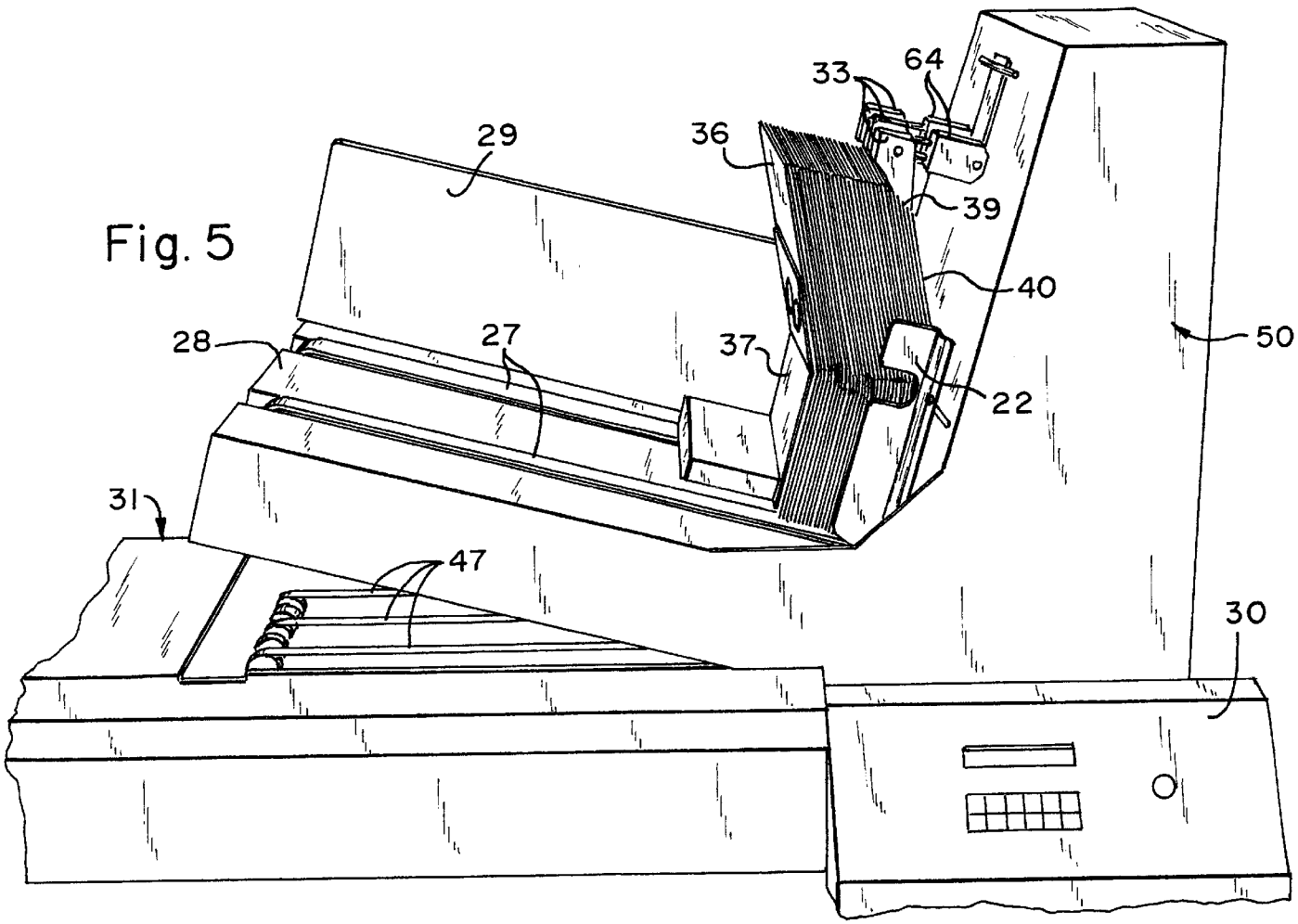

FIG. 5 is an elevational view of the sheet feeder invention with the feed table in the operational position and a paper stack in position.

Figure 6:
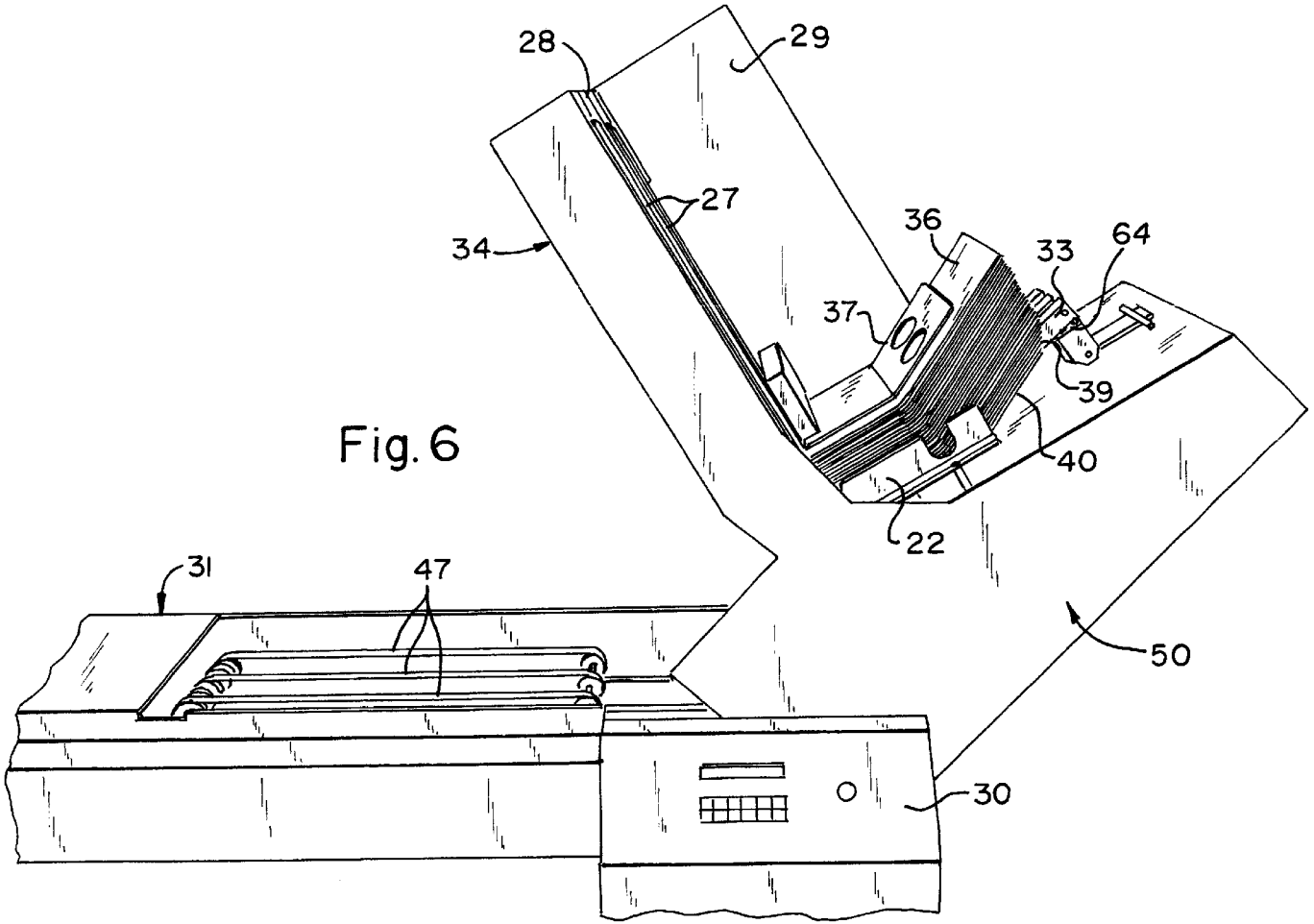

FIG. 6 is an elevational view of the sheet feeder invention with the feed table tilted back and a paper stack in position.

Figure 7:
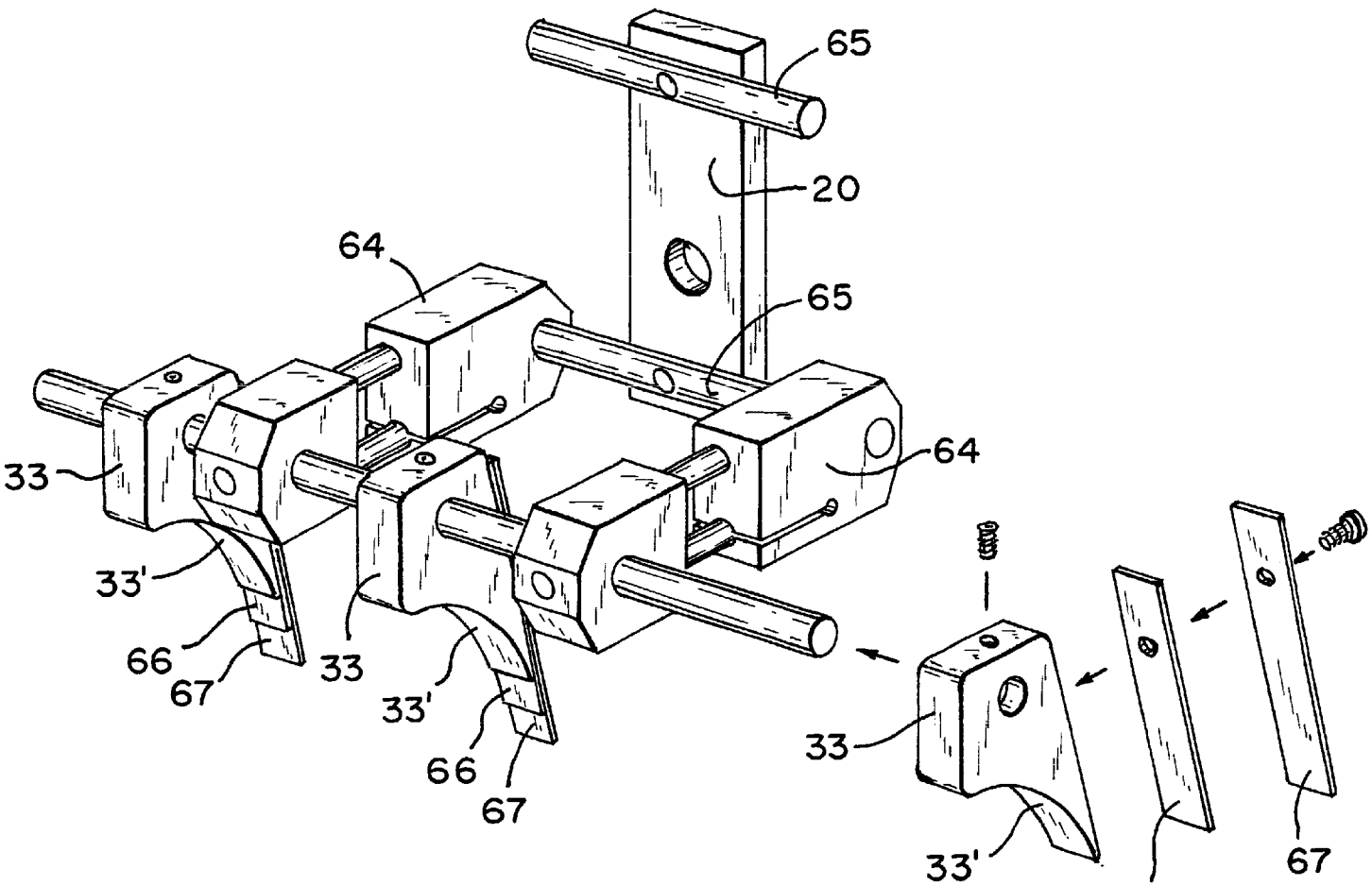

FIG. 7 is an exploded view of the upper edge paper guide assembly of the invention.

Figure 8:
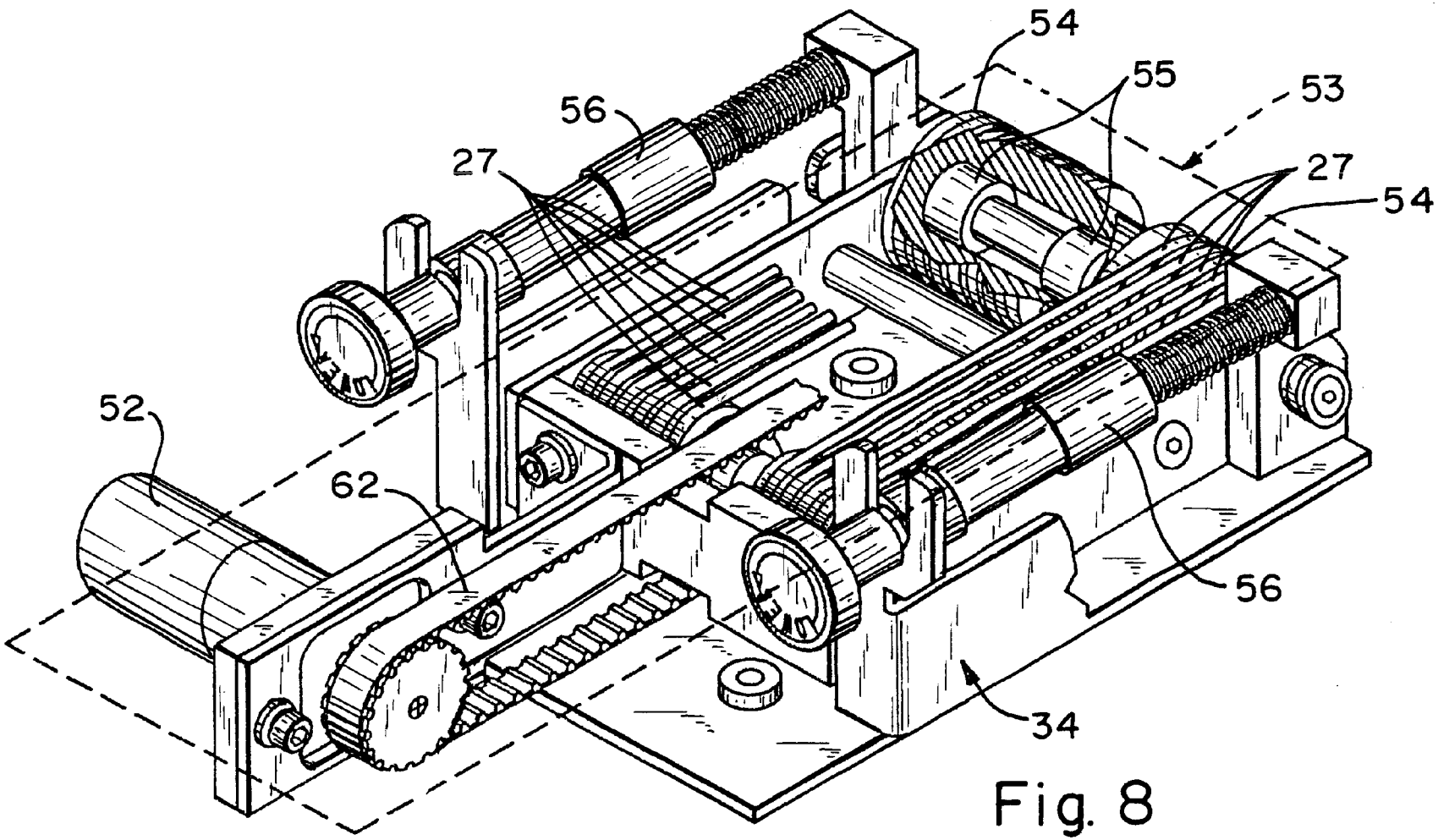

FIG. 8 is a perspective view of the drive mechanisms for the singulator assembly of the invention.

Figure 9:
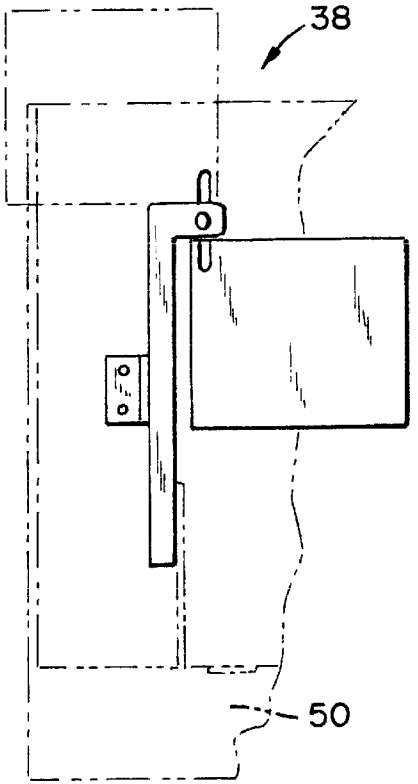

FIG. 9 is a rear elevational view of the paper stack support of the invention.

Figure 10:
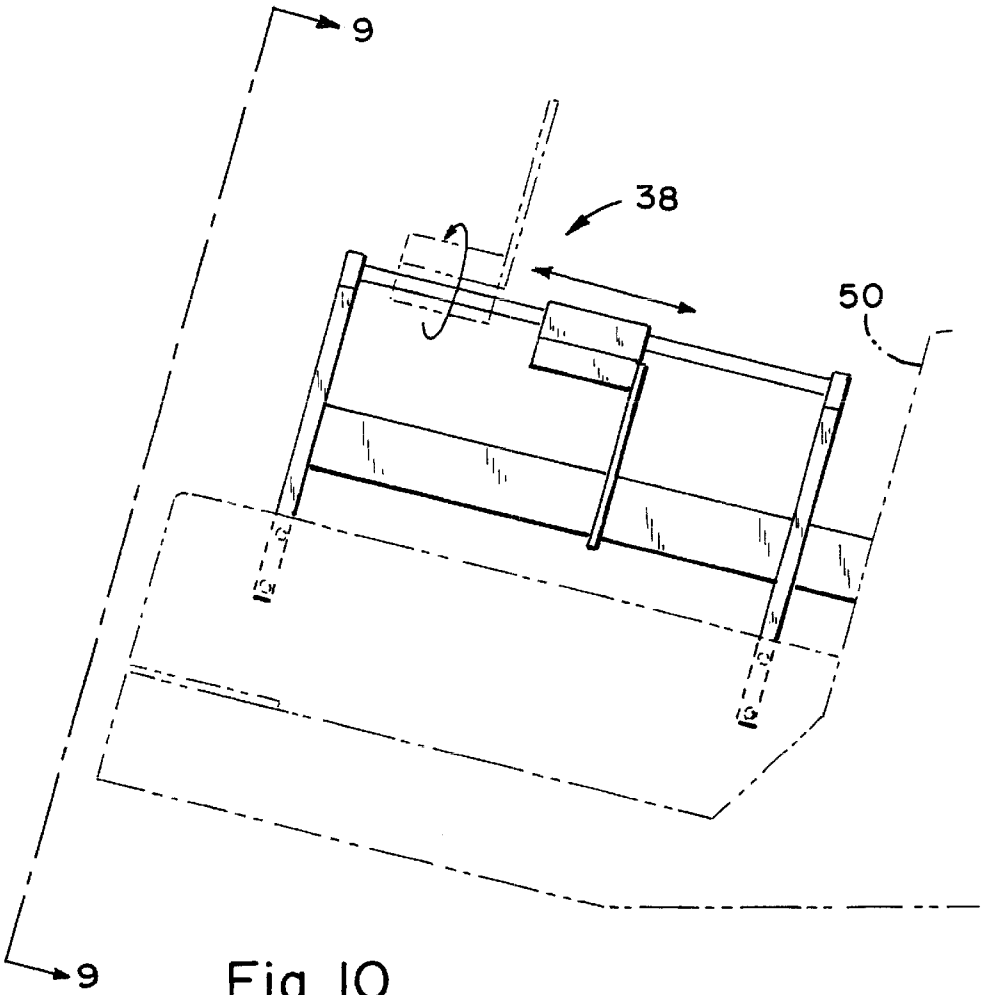

FIG. 10 is a side elevational view of the paper stack support of the invention.

Figure 11:
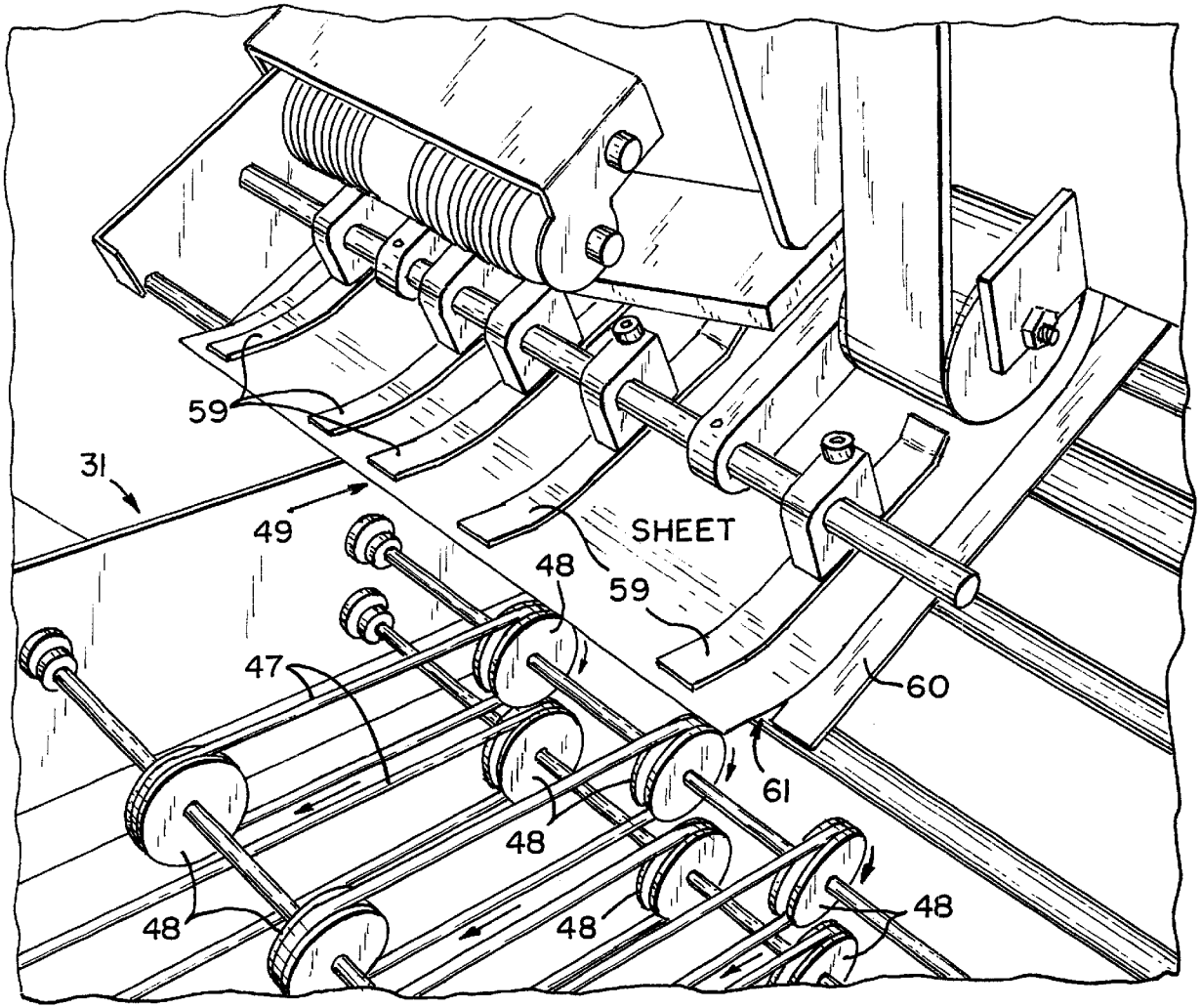

FIG. 11 is a perspective view of the feeder in the inoperative tilted-back orientation and showing the transport ramps and paper path leaving the singulator assembly with directional arrows showing the subsequent path between the transport rollers when in the operative position.

Figure 12:
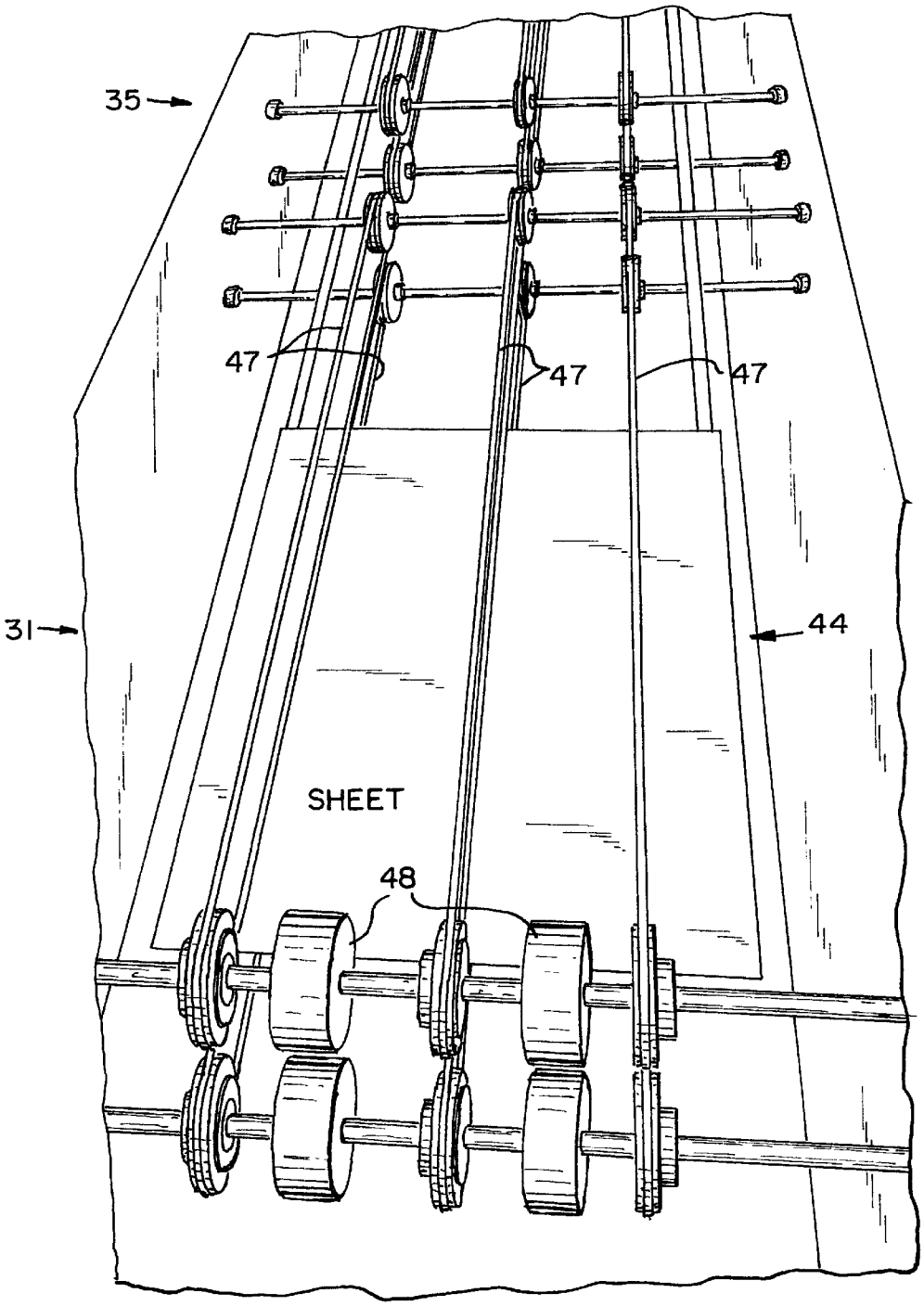

FIG. 12 is a perspective view of the paper path in the transport with a sheet passing therethrough.

Figure 13:
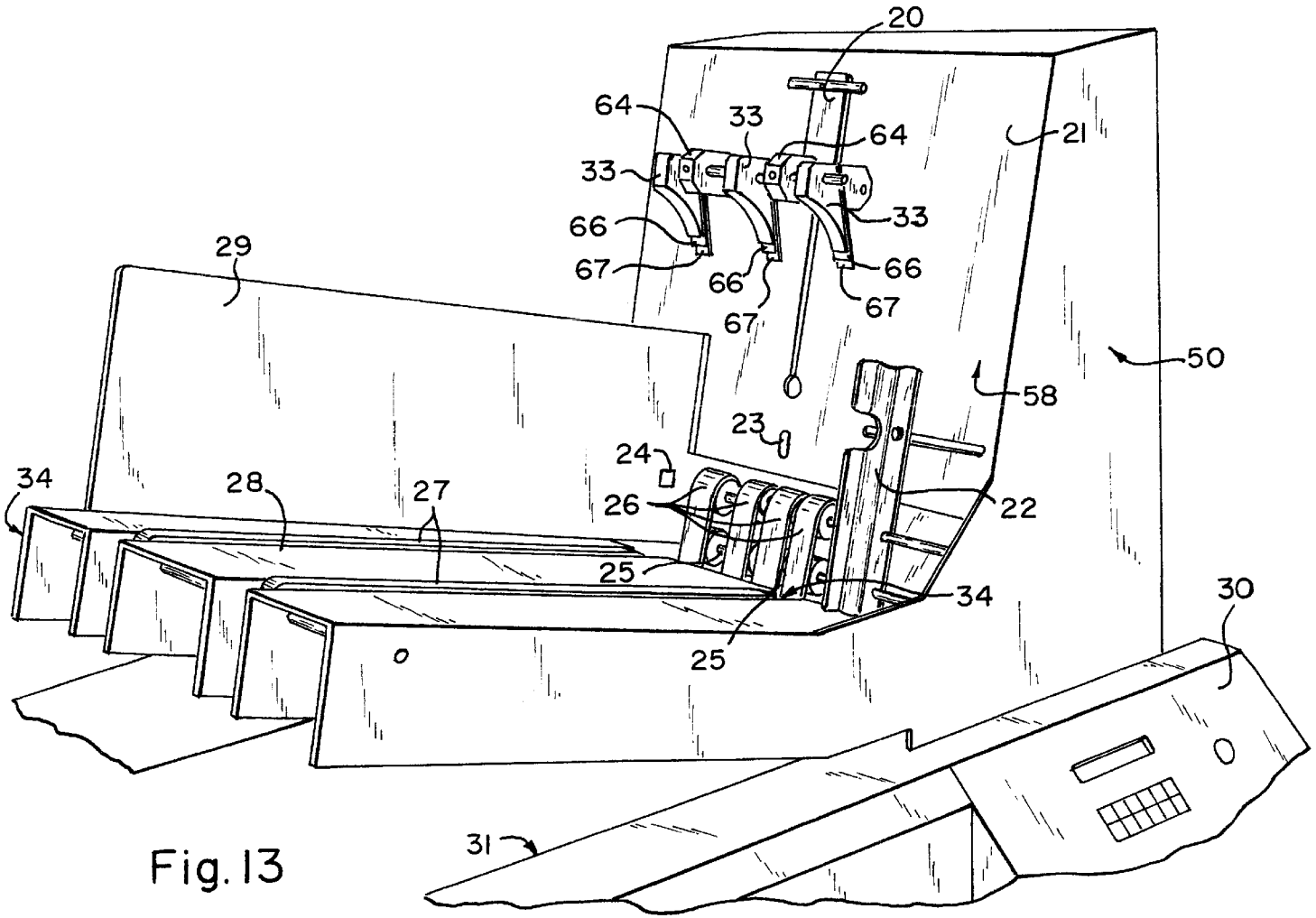

FIG. 13 is a perspective view of the feed table, the singulator assembly entry aperture from the feed table, side sheet guides and the upper edge paper guide assembly.

Figure 14:
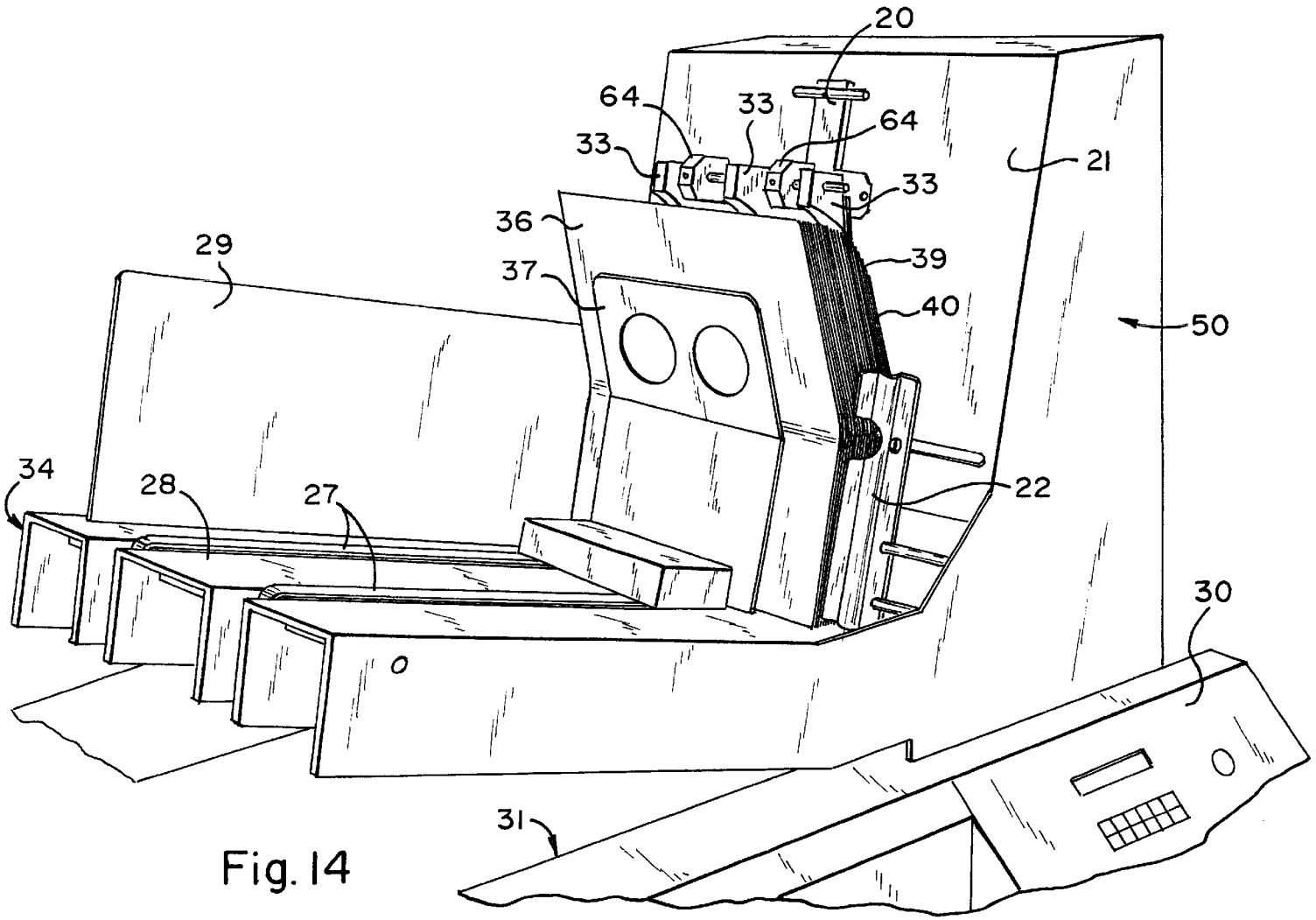

FIG. 14 is a perspective view of a loaded stack of paper sheets in position on the feed table.

Figure 15:
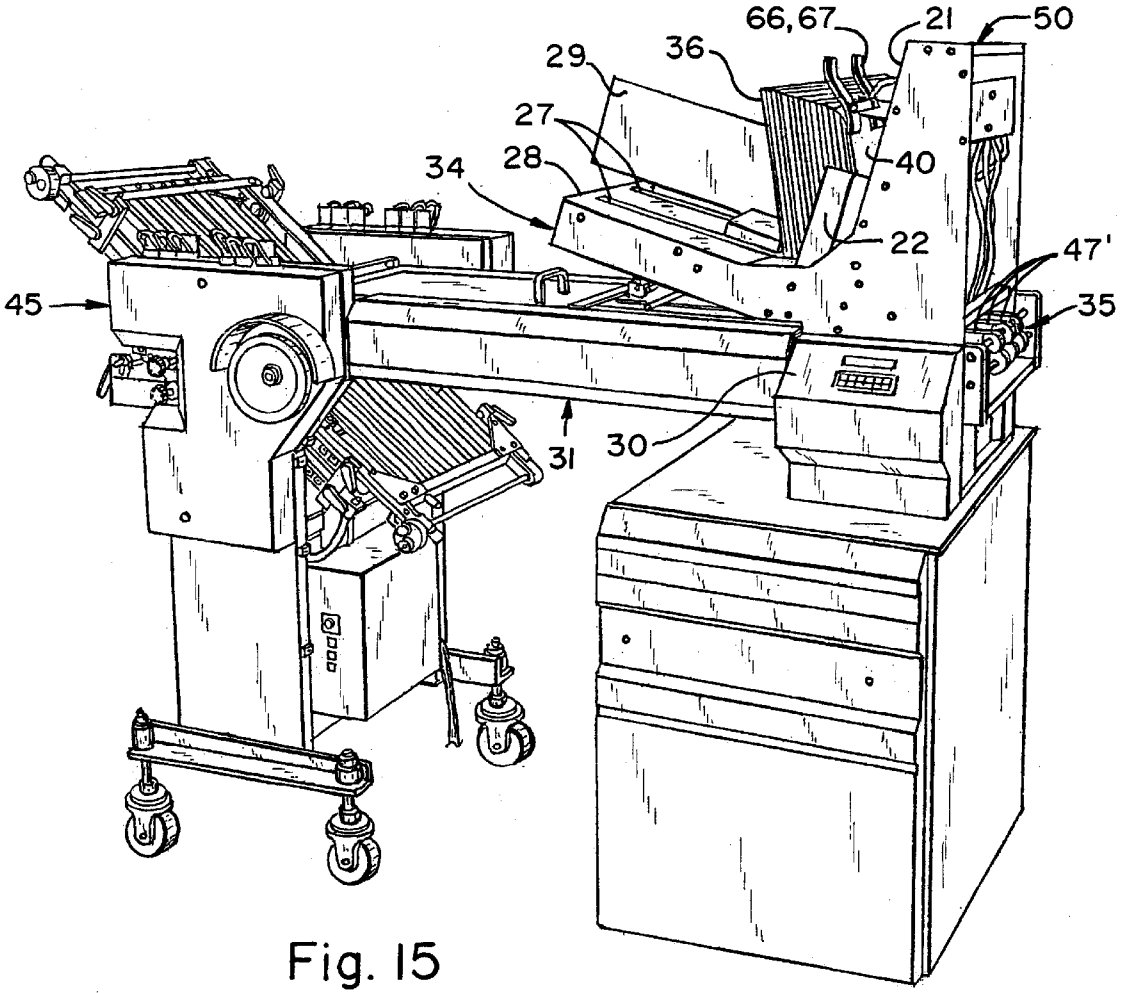

FIG. 15 is a perspective view of the high capacity sheet feeder, an alternate dual input transport, central processing unit control station and a downstream device.

Figure 16:
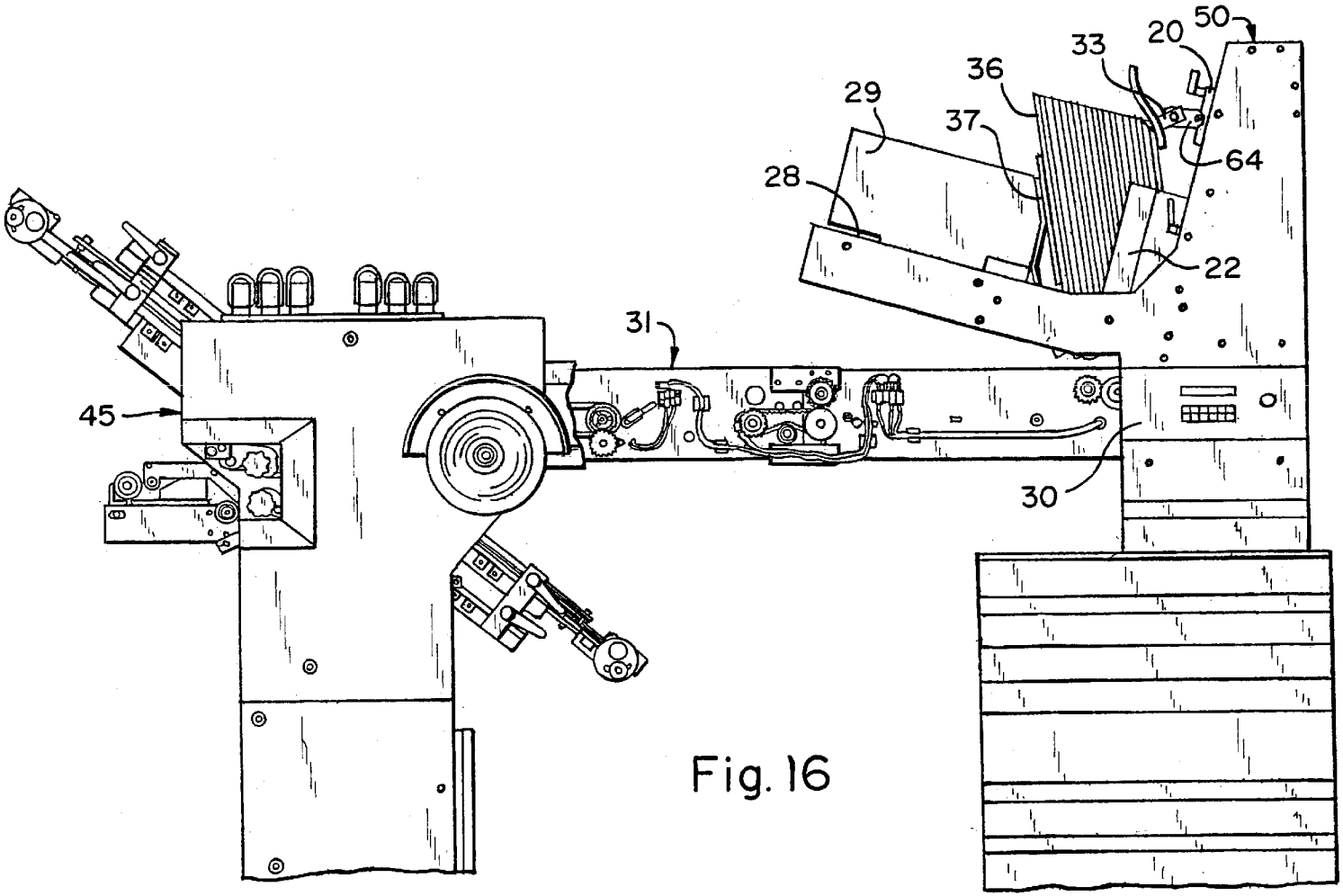

FIG. 16 is a side elevational view of the apparatus of FIG. 15.

Figure 17:
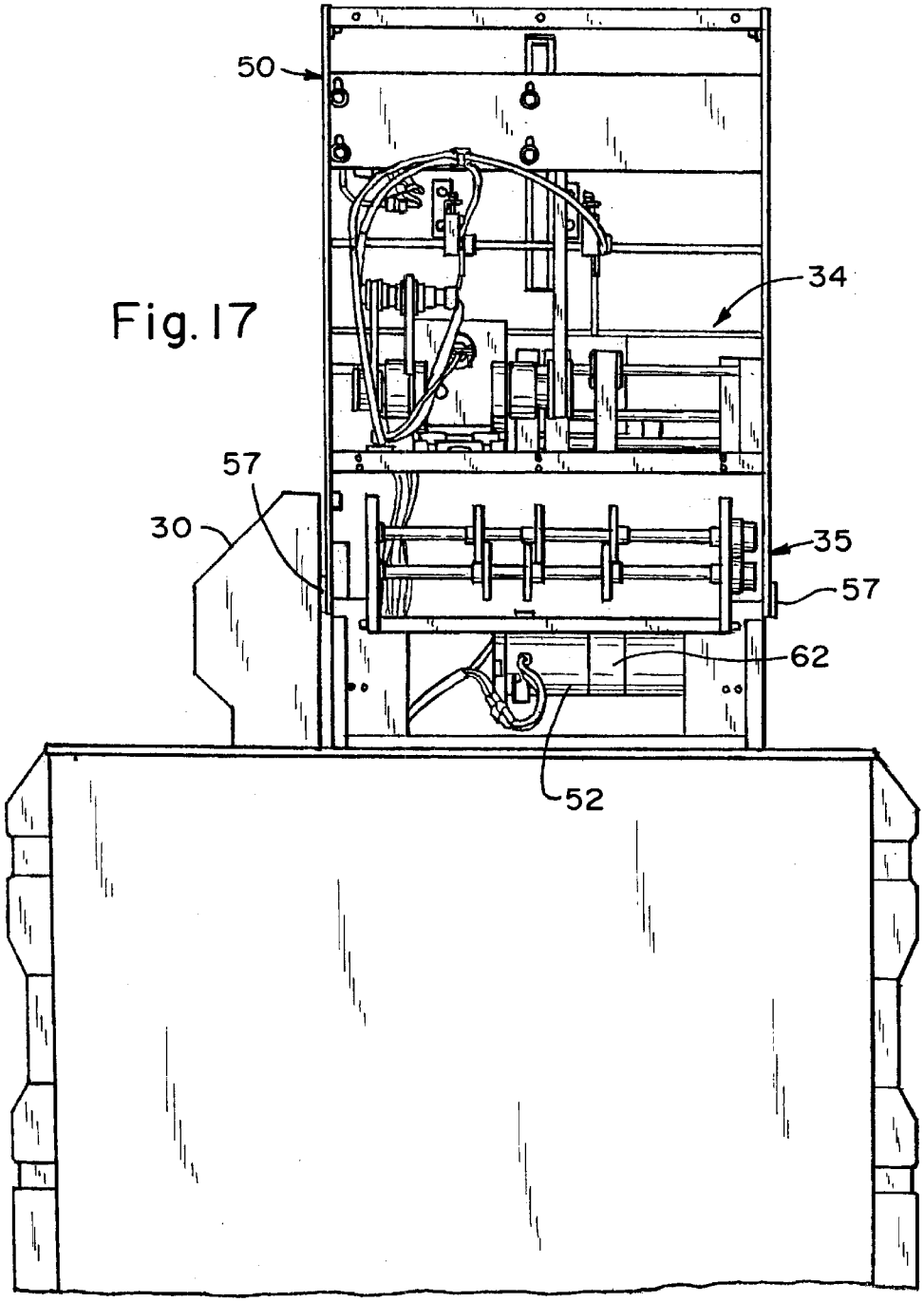

FIG. 17 is a rear elevational view of the apparatus of FIG. 15.

Figure 18:
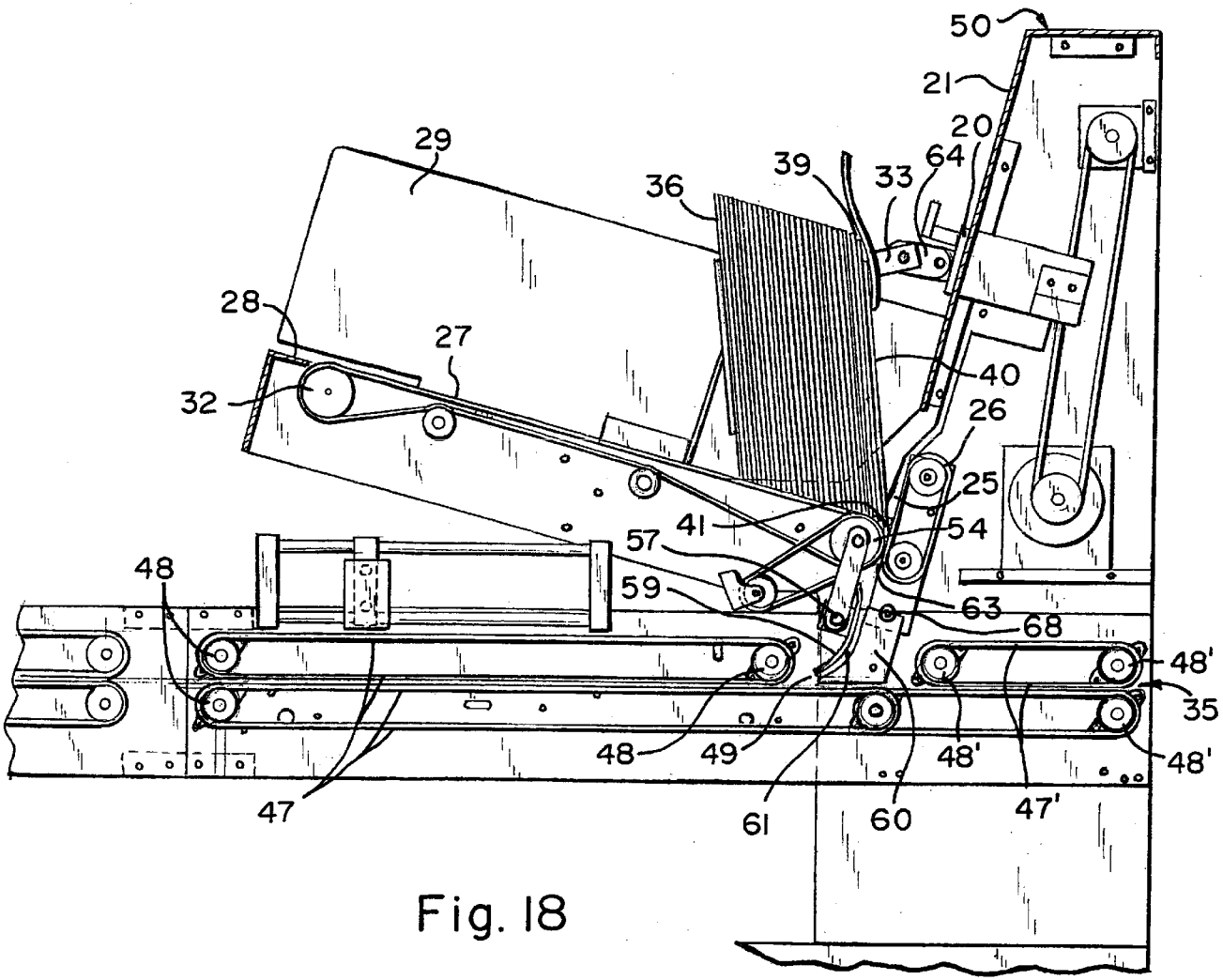

FIG. 18 is a cross-sectional side view of the sheet feeder and transport of FIG. 15.

DESCRIPTION OF PREFERRED EMBODIMENTS

The invention provides for feeding single sheets of paper from 8.5"×11" up to 11"×17" in size, and paper weights from 16 lbs. to 60 lbs. (+/−) stock with variable intermixed weights from 16 lbs. to 60 lbs. Stock (+/−). The paper is vertically stacked on the feed table (28) of sheet feeder 50 and the rear of the paper stack (36) is held in position during loading with the assistance of the positional paper stack support (38). Once the sheet feeder 50 is loaded, which can involve loading typically up to about 4,000 sheets, the positional paper stack support (38) is raised to the home position and replaced with the vertical stack support (37) to support the rear of the paper stack (36). The upper-edge guide assembly (FIG. 7) holds the top-front (39) of the paper stack (36) in position. The upper-edge guide assembly (FIG. 7) keeps the entire paper stack (36) away from the vertical deck (21) of the sheet feeder 50, and separates the lead documents (40) from the paper stack (36) maintaining consistent vertical positioning as the documents are fed into a singulator assembly (34). Two timing belts (hereafter referred to as creeper belts) (27) carry the paper to the singulator device (34) via two D.C. driven gear motors (32). The gear motors (32) can be independently or simultaneously controlled, depending on the application, to keep even pressure on feed belts (26) and are reversible in conjunction with the singulator (34) to remove jams and loaded paper. Left and right hand electronic or electromechanical switches (25) between feed belts (2) sense the paper stack (36) pressure sending a signal to the CPU (30) which advances the left and right creeper belts (27) for a predetermined degree of time and/or a predetermined number of pages.

The paper is then fed via feed belts (26) through the singulator assembly (34) comprising of said feed belts (26) and stationary rollers (stationary rollers hereafter refers to a plurality of round belting or a solid composite material around a cylindrical core) (54). The singulator assembly (34) is adjustable and has two adjustable tension settings (56) to assure that multiple sheets will not be allowed to pass together. The singulator assembly (34) is a plurality of stationary rollers (54) that are rotated by a D.C. gear motor (52) for removal of paper or indexed to compensate for belt wear.

A sensor (24) is provided for paper low sensing alerting the operator of a low paper condition. Without this sensor when the sheet feeder empties, a new start up process would be needed, which slows production. A feeder empty sensor (23) is provided to alert the operator that: (a) an end-of-job condition exists, which the operator would then put the feeder into the end-of-job mode and continue processing the remaining documents, (b) whereas the feeder would automatically proceed into an end-of-job mode and continue processing the remaining documents, or (c) an out of paper -condition exists, which the operator would reload paper into the feeder 50 and enter the begin job mode.

The paper is transported from the feed table (28) to a transport (31) between a set of positioning side guides (22 and 29) and continues through a controlled paper path gap (61) comprising of a plurality of transport ramps (60) and spring loaded guides (59) which capture and control the paper sheets while in transit. The spring loaded guides (59) maintain an even gap (61) to the transport ramps. Accessibility to the paper path gap (61) is provided by raising the spring-loaded guides up for clearing paper jams and servicing. Because the guides are spring-loaded and use adjustable positioning screws (68) they will return to their original position with relation to the transport ramps. The paper is held in the transport (31) until the CPU (30) calls for another piece to be fed from the feed table (28). The CPU (30) can be set to a predetermined page quantity (a set) either directly by the user or automatically via an integrated OMR, BCR or OCR reading system (optical mark recognition; bar code recognition; optical character recognition respectively). A page set can be either single-page or multiple pages. When the transport device (31) is emptied into the downstream device (45), which may be a folder as shown, the next piece is fed from the feeder into the transport (31). This process continues until the pre-determined page set (quantity) is reached. Another mode of operation is where the transport (31) holds the first page of a set waiting for the subsequent pages for that set to be delivered to the transport (31) and accumulated. Once the accumulated set is complete it is delivered to a downstream device (45).

An auxiliary input (35) having transport belts 47' driven by rollers 48' of the transport (31) is designed to accept another upstream device (46) such as any one of the following: a manual feed tray; universal friction or vacuum feeder, sheet feeder; or, 1-up or 2-up continuous forms processor, as shown in U.S. Pat. No. 5,887,864, filed Sep. 29, 1999. Documents (sheets) are fed from the upstream device (46) into the input of the transport via round belts (47) and held at the transport dump rollers (48). The CPU (30) can be set to a predetermined page (sheet) quantity (a set) either directly by the user or automatically via an integrated OMR, BCR or OCR reading system. A page set can be either single-page or multiple pages. When accumulating in a downstream device (45), the transport (31) is emptied into the downstream device and the CPU (30) simultaneously initiates the next document from the upstream device (46) to be fed into the transport (31). This process continues until the pre-determined page set (quantity) is reached. When accumulating in the transport (31), the transport (31) holds the first page of a set waiting for the subsequent pages for that set to be delivered to the transport (31) from the upstream device (46). Once the set is complete it is delivered to a downstream device (45).

The transport (31) has two inputs, the feeder input (49) and integrated auxiliary input (35) whereas documents from the feeder and an upstream device (46) can be staged or merged in the transport (31). These inputs can be used integrally allowing documents to be merged in the transport (31) or downstream device (45). Whereas documents are fed from the feeder (50) or upstream device (46) into the input of the transport (31) via round belts (47) and held at the transport dump rollers (48). The CPU (30) can be set to a predetermined page quantity (a set) divided between sheet feeder and upstream device (46) either directly by the user or automatically via an integrated OMR, BCR or OCR reading system. A page set can be either single-page or multiple pages. When merging in a downstream device (45), the transport (31) empties the first page of a merging set into the downstream device (45) and the CPU (30) simultaneously initiates the next document in that set from either the upstream device (46) or feeder (50) to be fed into the transport (31). This process continues until the predetermined page set (quantity) is reached in the down stream device (such as an accumulator) (45). When merging in the transport (31), the transport (31) holds the first page of a merging set fed from either the feeder (50) or upstream device (46) waiting for the subsequent pages for that set to be delivered to the transport (31) from the feeder (50) or upstream device (46). Once the set is complete it is delivered to a downstream device (45).

The sheet feeder has the ability to accept hand fed documents at its auxiliary input (35). A hand-feeding device located at (51), such as a tray, is provided for this application. Via the CPU (30), the sheet feeder may be manually put into the hand feed mode. In this mode the feeder will accept documents one at a time manually fed or automatically fed via an auxiliary device (alternately located at 51), such as a friction feeder into the transport (31) area and up to the transport dump rollers (48). At this time, depending on the desired result, the document (sheet) can: a) be delivered directly to the down stream device (45), b) accumulate in either the transport (31) or downstream device (45) by a predetermined set size or c) accumulate in either the transport or downstream device under control of OMR, BCR or OCR. All of these modes are especially useful in an in line inserting systems application where the operator would normally have to hand fold and stuff into an envelope. With either the predetermined set size or under control of OMR, BCR or OCR, the document will actually be delivered to the inserter system for manual or intelligent processing.

Reversing of the creeper belts (27) is synchronous with the reversing of the singulator (34) for removal of paper out of the singulator aperture (41). This is necessary when removal of the entire paper stack (36) is needed or multiple pages are fed simultaneously into the singulator (34). To accomplish this, two D.C. gear motors (32) that drive the creeper belts (27) and a D.C. gear motor (52) incorporated in the singulator assembly (34) are provided to allow for reversing the direction of the paper stack (36) away from the singulator aperture (41).

Creeper belt control is accomplished via left and right hand electromechanical switches (25) and the CPU (30). The stack position switches (25) sense the paper stack (36) position against the vertical deck (21) and the feed belts (26). When the stack position switches (25) are in the open position, the CPU (30) calls for the creeper belts (27) to advance. Each stack position switch (25) works independently of each other but advances the creeper belts (27) together. The creeper belt control is enhanced by the CPU (30). The user can set a predefined quantity of pages to be fed between creeper belt (27) advances. After a user defined page count is reached, the creeper belts (27) advance for a predetermined time or until the stack position switches (25) are both closed. If the stack position switches (25) are still open, the CPU (30) will instruct the creeper belt motors (32) to repeat the process. During the advancement the creeper belts (27) are pulsed. This entire process eliminates the chance for the electromechanical sensors (stack position switches) (25) to over compensate and advance too much paper to the feed belts (26) and singulator (34) which would result in uneven pressure at the feed belts (26).

A gate assembly (53) comprising a D.C. gear motor (52) rollers (54) clutched bearings (55) and timing belt (62) is provided for dynamic advancement of the stationary rollers (54) (stationary rollers hereafter refers to a plurality of round belting or a solid composite material around a cylindrical core). This feature enables automatically advancing the singulator. The D.C. gear motor (52) is mounted so that it moves with the stationary rollers (54) that are part of the gate assembly (53). In this way there remains a tight link between the D.C. gear motor (52) and stationary rollers (54) via the timing belt (62), eliminating any need for belt tensioning that would cause inaccurate drive transfer to the stationary rollers (54). The stationary rollers (54) are used in conjunction with the feed belts (26) for sheet separation. There is constant contact between these two surfaces both during paper feeding and while idle. The friction caused by the paper and feed belt travel causes wear to the stationary roller surfaces. This wear increases the gap (63) between the stationary rollers (54) and feed belts (26) causing multiple pages to be fed simultaneously which results in feeding errors. If it has to be done manually, the operator can mistake this increased gap for a tension adjustment. The operator will then make the tension adjustment to correct the problem and when the stationary roller is finally advanced to a new surface, the gap (63) is too tight and will cause jams and misfeeds. The automatic advancement feature eliminates these problems whereas the stationary rollers (54) are automatically advanced under CPU control for a preset degree of rotation at a pre-determined page count. To eliminate any possibility for forward rotation as the paper is transferred through the singulator (34), clutch bearings (55) are used in the stationary rollers (54). This also is necessary to eliminate excessive torque on the gear motor (52). The stationary rollers (54) are adjusted via two spring loaded tension adjustments (56). These adjustments give the singulator (34) a horizontal balance in relationship to the feed belts (26). This is necessary to eliminate variances in paper skew.

Manual Document Feeding is also enabled. The sheet feeder has the ability to accept hand fed documents at its auxiliary input (35). A hand-feeding tray located at (51) is provided for this application. Via the CPU (30), the sheet feeder may be manually put into the hand feed mode. In this mode the feeder will accept documents one at a time manually fed or automatically fed via an auxiliary device alternately located at (51), such as a friction feeder into the transport (31) area and up to the transport dump rollers (48). At this time, depending on the desired result, the document can: a) be delivered directly to the down stream device (45) b) accumulate in either the transport (31) or downstream device (45) by a predetermined set size or c) accumulate in either the transport (31) or downstream device (45) under control of OMR, BCR or OCR. All of these modes are especially useful in an in line inserting systems application where the operator would normally have to hand fold and stuff into an envelope. With either the predetermined set size or under control of OMR, BCR or OCR, the document will actually be delivered to the inserter system for manual or intelligent processing.

The tilt back feature (FIGS. 6 and 11) allows the feeder portion (50) to be tilted away from the transport (31) area for error recovery, adjustments, servicing and replacement of the singulator assembly (34). The feeder (50) is physically mounted to the transport (31) via two hinge points (57) allowing access to the transport area (31). This feature enables the feeder (50) to be lifted with a stack of paper still loaded by way of two gas springs (58) calibrated to be effective over a range from fully loaded to empty. Due to the design features including positioning side guides (22 and 29), spring loaded guides (59) and transport ramps (60), positioning side rails (44) and transport feeder input (49), the feeder (50) can be returned to its home position (FIG. 5) without disturbing the original set up conditions which is critical in keeping up productivity.

The invention also enables auxiliary input. The transport device input (35) is designed to accept another upstream device (46) such as, for example, any one of the following: a manual feed tray, universal friction or vacuum feeder, sheet feeder, 1-up or 2-up continuous forms processor, as shown in U.S. Pat. No. 5,887,864. Whereas documents are fed from the upstream device (46) into the input of the transport via round belts (47) and held at the transport dump rollers (48). The CPU (30) can be set to a predetermined page quantity (a set) either directly by the user or automatically via an integrated OMR, BCR or OCR reading system. A page set can be either single-page or multiple pages. When accumulating in a downstream device (45), the transport (31) is emptied into the downstream device and the CPU (30) simultaneously initiates the next document from the upstream device (46) to be fed into the transport (31). This process continues until the pre-determined page set (quantity) is reached. When accumulating in the transport (31), the transport (31) holds the first page of a set waiting for the subsequent pages for that set to be delivered to the transport (31) from the upstream device (46). Once the set is complete it is delivered to a downstream device (45).

Dual input is also enabled. The transport (31) has two inputs, the feeder input (49) and integrated auxiliary input (35) whereas documents from the feeder and an auxiliary (upstream) device (46) can be staged or merged in the transport (31). These inputs can be used integrally allowing documents to be merged in the transport (31) or downstream device (45). Whereas documents are fed from the feeder (50) or upstream device (46) into the input of the transport (31) via round belts (47) and held at the transport dump rollers (48). The CPU (30) can be set to a predetermined page quantity (a set) divided between feeder (50) and auxiliary input device (35) either directly by the user or automatically via an integrated OMR, BCR or OCR reading system. A page set can be either single-page or multiple pages (sheets). When merging in a downstream device (45), the transport (31) empties the first page of a merging set into the downstream device (45) and the CPU (30) simultaneously initiates the next document in that set from either the upstream device (46) or feeder (50) to be fed into the transport (31). This process continues until the pre-determined page set (quantity) is reached in the down stream device (45) (such as an accumulator). When merging in the transport (31) itself, the transport (31) holds the first page of a merging set fed from either the feeder (50) or upstream device (46) waiting for the subsequent pages for that set to be delivered to the transport (31) from the feeder (50) or upstream device (46). Once the set is complete it is delivered to a downstream device (45).

Upper edge guide assembly (FIG. 7) comprises two telescoping positioning brackets (64) supporting a plurality of support wedges (33) using a unique separation technique for retaining the paper stack (36) in a vertical position. The two telescoping positioning brackets (64) are mounted to the vertical deck (21) via a vertically adjustable mounting assembly (20). The telescoping positioning brackets (64) are used to horizontally adjust the support wedges (33) having edge-contacting arcing wedge-like surfaces 33', which mount to the telescoping positioning brackets (64) via a common mounting shaft (65). The support wedges (33) are independently mounted and are positional for adjustment of the arcing surfaces 33'to the paper stack (36). The vertical mounting assembly (20) provides two mounting positions for convenient relocation of the support wedges (33) and telescoping positioning brackets (33 and 64) for 11" and 14" documents. Actual separation and paper stack support are accomplished via two flexible spring like fingers (66 and 67) mounted directly to each support wedge (33) adjacent the bottom of surface 33'. The primary finger (66) is semi-flexible in order to hold back the paper stack (36) and the secondary finger (67) is more flexible creating minimal pressure on the lead document (40) while keeping it captured. The weight of the paper stack (36) is mainly supported by the surface 33' and sheets close to the front of the stack (36) are supported by the primary finger (66) on each support wedge. As each paper (sheet) is drawn into the singulator (34), the next page (sheet) in the stack is pulled down and under the primary finger (66) until it rests between the paper stack (36) and the secondary finger (67). By means of pivoting the support wedges (33) and thereby the surfaces 33' into or away from the paper stack (36), the amount of drag can be minimized. Now the lead document (sheet) (40) is captured between the paper stack (36) and the secondary flexible finger (67) ready to be fed to the singulator (34). This process is critical in separating the next page to be fed releasing a majority of the drag or friction caused by the weight of the paper stack (36) prior to being driven or drawn into the singulator (34) by the feed belts (26).

The input tray option (at 51) allows the operator to automatically process re-work pieces. By putting the high capacity sheet feeder in this mode the operator can manually hand feed documents in the tray and process through the inserter. The low volume feeder attachment is for accumulating small amounts of reworked documents to be loaded and automatically fed to the staging area of the high capacity sheet feeder. The sheet feeder can accept other high capacity sheet feeders in tandem. Each feeder would process documents and transport to the next up-stream feeder. The pages can be processed separately or combined with another tandem feeders output for merging and matching functions.

A continuous input device such as a universal continuous forms processor, such as my coinvented, U.S. Pat. No. 5,887,864 can be connected to the input of the sheet feeder as well. This would allow for any combination of continuous form documents to be combined with the output of the high capacity sheet feeder for merging and matching functions.

Another alternative would permit sheets stacked and fed through and just folded as separate sheets. The sheets fed here would be controlled by the read marks information would be grouped and folded together.

Yet another alternative use would be feeding sheets to be manually handled after folding. Keeping the inserter running, would enable processing through the inserter but take advantage of automatically table fed sheets.

Both variations can be run in unison with each other or selected to run independently. This provides for an economical document processing solution. Thus the capital investment in equipment could be maximized by the use of a single system to perform a wide variety of tasks by a single system. Presently, no system combines all these described functions in a single system, instead requiring a plurality of input and output devices, frequently certain of them requiring installation and setup to the exclusion of others, greatly decreasing efficiency in operation. With use on a system inserter one would have a universal document processing solution system processing both cut sheet and continuous in one front end.

As many and varied modifications of the subject matter of this invention will become apparent to those skilled in the art from the detailed description given hereinabove, it will be understood that the present invention is limited only as provided in the claims appended hereto.

What is claimed is:

1. A high capacity sheet feeder comprising:

a feed table capable of holding a plurality of sheets edgewise thereon for feeding one sheet at a time to a transport assembly, said feed table having an operable position slanted downwardly relative to horizontal;

creeper drives communicating through said feed table for incrementally advancing a stack of sheets and said creeper drives being independently driven by motors;

an upper edge guide assembly being spaced from said feed table a distance to communicate with upper edges of sheets stacked on said feed table;

a generally vertical deck extending generally upwardly from said feed table and supporting said top edge guide assembly to space an advancing stack of sheets therefrom;

a singulator assembly having a sheet-receiving aperture for passing therethrough one sheet at a time; and a controlled paper gap assembly for receiving individual sheets from said singulator assembly and for feeding sheets therefrom downstream.

2. The high capacity sheet feeder as in claim 1 wherein a central processing unit electronically communicates with motors independently driving each creeper drive whereby each is independently driveable in forward and reverse directions.

3. The high capacity sheet feeder as in claim 2 wherein the feeder includes stack position switches for sensing the paper stack position and signaling the central processing unit to activate the creeper drive motors to advance the stack.

4. The high capacity sheet feeder as in claim 3 wherein each stack position switch works independently and is capable of signaling the central processing unit to advance the creeper drives together whereby any switch can individually signal for creeper drive advancing motion.

5. The high capacity sheet feeder as in claim 1 wherein the feeder includes a low sheet sensor for signally when the stack of sheets is at a predetermined low paper condition for detecting end-of job conditions.

6. The high capacity sheet feeder as in claim 1 wherein the singulator assembly is driven by a motor and the motors driving the creeper drives are synchronously driven with the singulator assembly motor to be conjunctively advanceable, and reversible in order to remove sheet jams.

7. The high capacity sheet feeder as in claim 1 wherein the creeper drives comprise left and right belts independently driven by said motors, said motors being responsive to left and right paper stack sensors for sensing the pressure of the stack on the feed table for independently signaling the motors to drive either or both left and right belts for a predetermined time or for a predetermined number of pages.

8. The high capacity sheet feeder as in claim 1 wherein the feeder includes positioning side guides at either side of the feed table.

9. The high capacity sheet feeder as in claim 1 wherein the controlled paper gap assembly comprises a plurality of transport ramps and spring loaded guides for capturing and controlling the paper received from the singulator and to maintain an even gap at the transport ramps.

* * * * *